United States Patent [19]

Dix et al.

[11] Patent Number: 4,520,629

[45] Date of Patent: Jun. 4, 1985

[54] DRIVE MECHANISM FOR A REFRIGERATOR WITH CLEARANCE SEALS

[75] Inventors: Robert M. Dix, Dallas; Timothy A. Ellis, Plano; Gary W. Andrews, Dallas, all of Tex.

[73] Assignee: Texas Instruments Incorporated, Dallas, Tex.

[21] Appl. No.: 526,851

[22] Filed: Aug. 26, 1983

[51] Int. Cl.[3] ..... F25B 9/00

[52] U.S. Cl. ..... 62/6; 60/520; 74/569; 92/136

[58] Field of Search ..... 62/6; 60/520; 92/136; 74/569

[56] References Cited

U.S. PATENT DOCUMENTS

| | | | |
|---|---|---|---|
| 3,118,322 | 1/1964 | Oldberg et al. | 74/569 |
| 3,416,308 | 12/1968 | Livezey | 62/6 |
| 3,574,998 | 4/1971 | von Bredow et al. | 62/6 |

*Primary Examiner*—Ronald C. Capossela

*Attorney, Agent, or Firm*—Alva H. Bandy; Leo N. Heiting; Melvin Sharp

[57] ABSTRACT

An improved cryogenic refrigerator having a drive mechanism suitable for use with gap or clearance seals is disclosed. The drive mechanism includes two reciprocating members, e.g. piston and regenerator/displacer, driven by a common rotating drive shaft. The regenerator/displacer portion of the drive shaft includes a roller at one end in engagement with a rod base plate for driving a rod connected to the regenerator/displacer and a spring for returning the regenerator/displacer simultaneously with the withdrawal of the drive shaft. The piston portion of the drive shaft is connected to a first end of a hollow body. The second end of the hollow body which is opposite the first end has the piston rigidly affixed thereto. The hollow body has a portion adjacent the first end supported by a guide whereby the piston is substantially isolated from side force loads during reciprocation.

13 Claims, 3 Drawing Figures

DRIVE MECHANISM FOR A REFRIGERATOR WITH CLEARANCE SEALS

This invention relates to reciprocating devices such as, for example, cryogenic refrigerators or gas compressors and more particularly to reciprocating devices utilizing gap or clearance seals.

In the past, reciprocating devices such as the cryogenic refrigerator disclosed in U.S. Pat. No. 3,899,119 issued June 10, 1975, have a motor, a crankshaft, a connecting rod and a piston (see the prior art device FIG. 1). An eccentric cam on the drive shaft imparts the desired reciprocating action to the piston. In operation the connecting rod swings through an arc owing to the cams circular motion. The result is a force vector having a side force component which must be absorbed by the piston sealing mechanism to establish static equilibrium.

The piston/cylinder sealing mechanism is to prevent "blowby". As shown in FIG. 1 the prior art sealing mechanisms depend upon contact between the seal lip and the cylinder wall for sealing action; this contact creates friction and a substantial increase in power consumption. The friction wears out the seals and the seal particles generated by the wear and tear of the seals disperse throughout the machine further degrading performance. Thus the cost of parts, maintenance and power is increased as well as the "downtime" of the machine.

To reduce this side force vector and provide a more stable drive mechanism, it has been necessary to keep the arc through which the rod swings as small as possible (maximum 8 degrees). To this end a rod length that is at least 3.5 times greater than the crankshaft stroke is required. To this length must be added the length for making rod end connections (bearings, flex pivots, ball joints, etc.) This length increases the overall length of the machine considerably.

More recently a new seal technology commonly referred to as "clearance" or "gap" sealing new developed. The clearance seal uses a small, well controlled gap between the reciprocating member and a sleeve. The gap is sufficiently small as to have a very high resistance to fluid flow and thereby forms an effective seal. The seal's effectiveness is dependent upon the length, diameter and radial gap. The gap is the most critical. Thus, it is common to use a radial gap of 2 to 4 micrometers for sealing fluids such as helium.

The side force vector has precluded the use of clearance seals as the sealing mechanism and limited their use to machines in which the forces acting on the piston occur only in the axial direction to prevent piston/cylinder binding and wear.

Accordingly it is an object of this invention to isolate the piston/cylinder sealing mechanism from the side force vector attending conversion of rotating motion of reciprocating motion.

Another object of the invention is to provide a drive mechanism suitable for miniaturization of the reciprocating device.

Yet another object of the invention is to improve the effectiveness of the seal.

Briefly stated the invention comprises a reciprocating device having at least one or more reciprocating members configured with either piston/cylinder clearance seals or friction seals and driven by a common rotating drive shaft configured to isolate substantially the piston/cylinder seals from side force vectors generated by the rotating drive shaft.

The novel features characteristic of the embodiment of the invention may best be understood by reference to the following detailed description when read in conjunction with the accompanying drawings, wherein.

Figure 1:
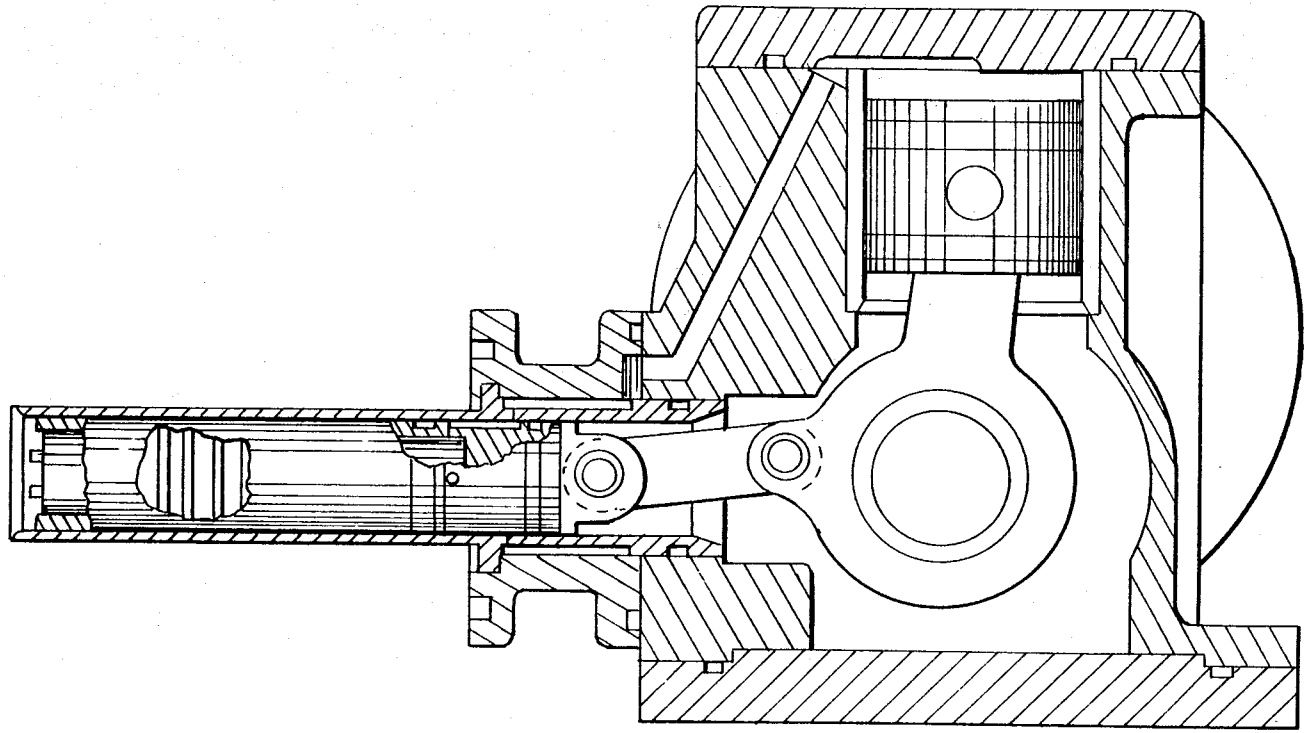
Fig. 1 PRIOR ART
FIG. 1 is a cross-sectional view showing the configuration of a prior art cryogenic refrigerator.
Figure 2:
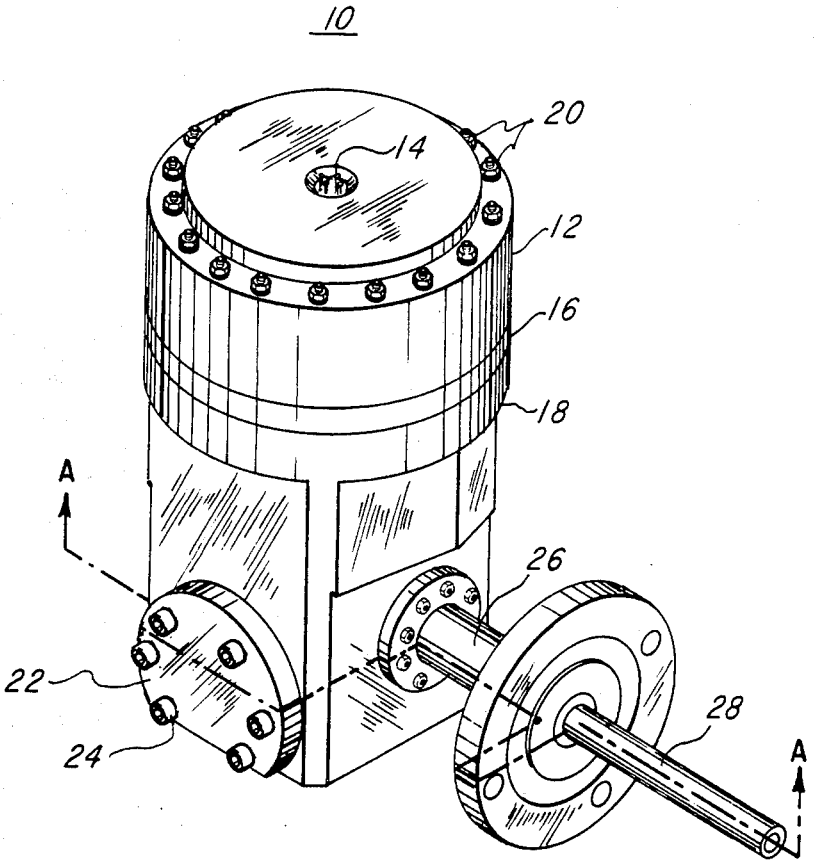
FIG. 2 is an isometric view of the cryogenic refrigerator incorporating the present invention.

Referring now to FIG. 2 in which is shown for description purposes only and not by way of limitation, a cryogenic refrigerator 10 embodying the present invention. The cryogenic refrigerator 10 has an electronics housing 12 for the refrigerator electronics, and electrical input terminals 14 for connection to a suitable power source. A motor stator mount 16 is sandwiched between the electronics housing and housing 18. The electronic housing and motor stator mount are attached to the housing by a plurality of bolts 20. The housing 20 includes a piston cap 22 attached thereto by bolts 24 and a clearance seal and regenerator/displacer rod housing 26. A cold finger 28 has one end mounted in the housing 26.

Figure 3:
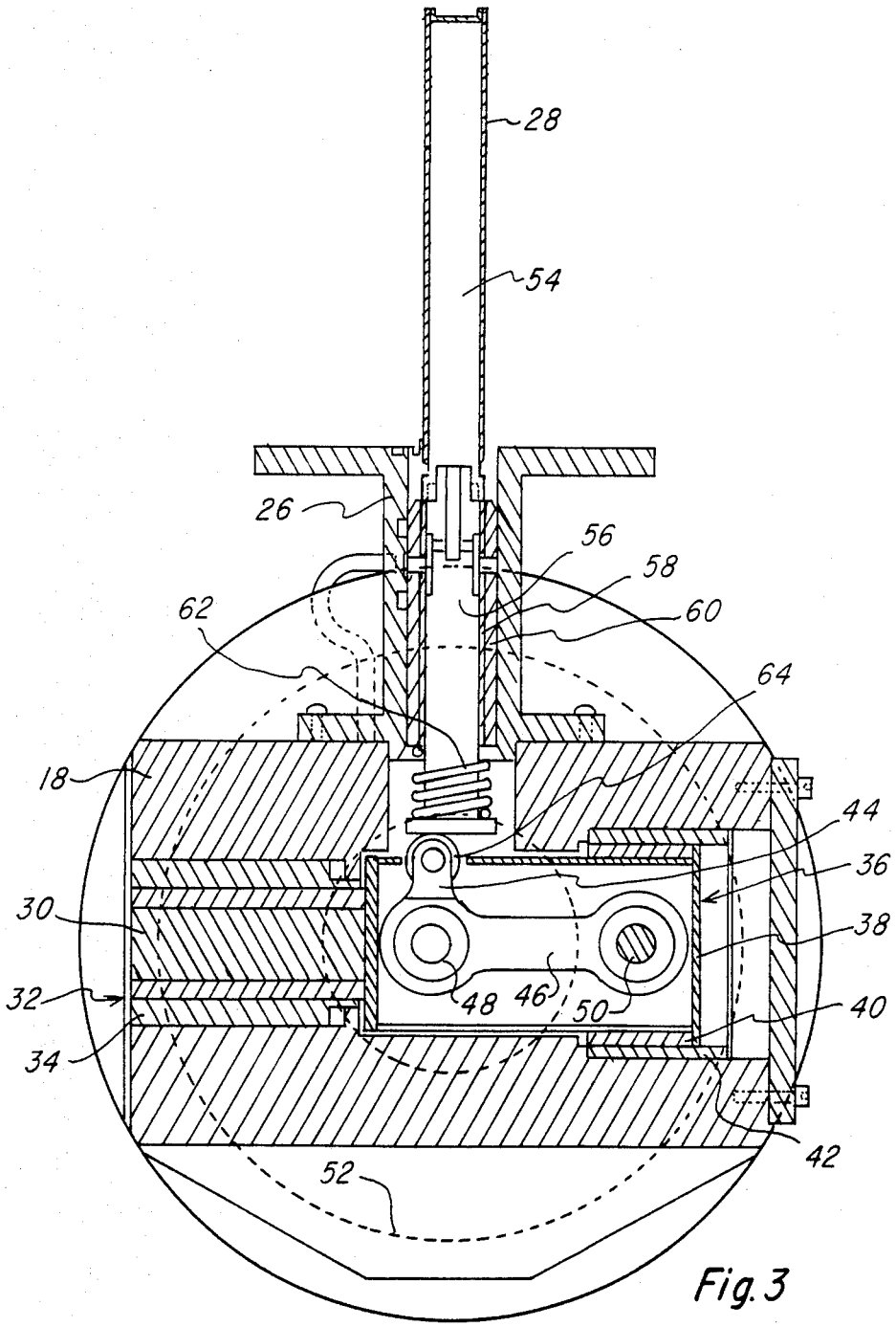
FIG. 3 is a cross-sectional view of the cryogenic refrigerator taken along line A—A of FIG. 2.

Referring now to FIG. 3, the housing 18 houses a first reciprocating member which is a cryogen compressor piston 30. A clearance seal 32 is formed between the outer diameter of the piston 30 and a sleeve 34. Sleeve 34 is rigidly connected to the housing 18. A piston guide assembly 36 includes a hollow body 38 which may be in the form of a cylinder having an end to which the piston 30 is affixed, an end portion opposite the piston 30 and a body portion therebetween. A hollow body support (bearing) member 40 is rigidly affixed to the end portion of the hollow body and defines the end portion thereof. A guide member 42 is rigidly attached to housing 18 and the hollow body support (bearing) member 40 is slidably mounted in the guide member 42.

A connecting rod 46 has one end attached to a crankshaft 48 and a second end connected to a wrist pin 50 journaled in the end portion of hollow body 38. The crankshaft 48 is driven by a motor 52 to drive the connecting rod 46 through an arc of angle $\phi$. The connecting rod 46 reciprocates the hollow body 38 and the piston 30 attached thereto. The piston 30 and the piston guide assembly 36 is centered within the motor envelope, thus, achieving the goal of a compact device.

In this construction, the piston 30 can have its diameter (width) varied at will by the designer to yield an optimum diameter/stroke ratio. With the guide 42 in juxtaposition to the wrist pin 50 the mechanism directs side thrust loads into the guide area of the piston guide assembly. That is, the side force is countered by the guide because the proximity of the guide support to the force input requires the guide to absorb the load. Any couples in the mechanism produce only a very slight reaction at the seal 32. Thus by placing the guide member 42 (fulcrum) at or near the input force, and by using a long lever arm (the distance from the wrist pin 50 to the seal 32), the contribution of the seal to the force balance is negligible and the seal 32 is substantially isolated. Another benefit of the long lever arm is that the mechanism is tolerant to postional errors between the guide and piston surfaces.

The second reciprocating member 54 is, in our example, a regenerator/displacer 54 mounted for reciprocal motion within the cold finger 28. The regenerator/displacer 54 is fixed to a first end of rod 56. The second end of rod 56 is a flanged end which forms on one side a bearing plate and on the opposite side a stop, the purpose of which will be described hereinafter.

A clearance seal 58 is formed for the second reciprocating member by the gap between the body of rod 56 and a sleeve 60. Sleeve 60 is mounted in the clearance seal housing 26 attached to housing 18. A compression spring 62 is mounted between the end of sleeve 60 and the flanged end of rod 56; these ends form stops for the compression spring 62. A roller means 64 is fixed to an arm or cam 44 of the connecting rod 46 as shown through a slot in cylinder 38.

In operation the crankshaft 48 drives the connecting rod 46 which, in turn, moves the roller 64 forward to push the rod 56 forward without imparting substantial side forces to the clearance seal 58. The forward motion of the rod drives the regenerator/displacer forward and compresses the compression spring 62. The compression spring 62 acts to return the rod and regenerator/displacer simultaneously with the backward movement of the crankshaft arm (cam) 44. It will be readily apparent to one skilled in the art that this drive mechanism reduces substantially the refrigerator's length in the cold finger axis, and that if the reciprocating device has only one reciprocating member either drive arrangements may be used to meet the particular need.

Although preferred embodiments of the present invention have been described in detail, it is to be understood that various changed, substitutions, and alterations can be made therein without departing from the scope of the invention as defined by the appended claims.

What is claimed:

1. A cryogenic refrigerator comprising:

(a) a housing, (b) a cold finger means operatively connected to the housing, said cold finger means including a regenerator/displacer;

(c) a motor connected to the housing;

(d) a crankshaft operatively connected to the motor;

(e) a connecting rod having first and second end portions, said first end portion operatively connected to the crankshaft and to the regenerator/displacer of the cold finger;

(f) a piston guide means having a guide member rigidly fixed to the housing, a hollow body member having a portion thereof mounted in said guide member, said hollow body journalled to the second end of the connecting rod for reciprocal movement in response to movement of the connecting rod; and (g) a clearance seal, said clearance seal including a cryogen compression piston rigidly fixed to the hollow body of the cylinder means and a sleeve member ridigly fixed to the housing in a spaced relationship to the piston to form an elongated sealing gap therebetween, whereby said cryogen compression piston is reciprocated substantially free of a clearance seal degrading side force vector.

2. A cryogen refrigerator according to claim 1 further including a clearance seal housing, a force member affixed to the connecting rod, a clearance seal rod having a flanged end, said flanged end being in operable association with the first member to form a bearing plate for the force member, a sleeve means rigidly fixed to the clearance seal housing, said sleeve member coacting with the clearance seal rod to form a clearance seal, and wherein said regenerator/displacer of the cold finger means is connected to the end of the clearance seal rod opposite the flanged end.

3. A cryogenic refrigerator according to claim 2 further including a return means for returning the clearance seal rod substantially simultaneously with the withdrawal of the force member.

4. A cryogenic refrigerator according to claim 3 wherein the return means is a compression spring operably positioned between the clearance seal sleeve and flange of the flanged end rod.

5. A cryogenic refrigerator comprising:

(a) a plurality of reciprocating members;

(b) a means for producing rotary motion;

(c) a connecting rod having a first end operatively connected to the means for producing rotary motion;

(d) a cold finger means including a first reciprocating member of the plurality of reciprocating members;

(e) a first drive mechanism having a forward driving means operatively connected to the connecting rod, a force receiving means operatively connected to the first reciprocating member and in operable association with the forward driving means for driving the first reciprocating member forward and a return means in operable association with the force receiving means connected to the first reciprocating member for driving the reciprocating member backward substantially simultaneously with the backward movement of the forward driving means whereby a reciprocating motion is imparted to the first reciprocating member through action of the forward driving means and return means;

(f) a second reciprocating member; and (g) a guide means having a moveable means operatively connected to a second end of the connecting rod and the second reciprocating member, said guide means for converting the rotational movement of the means for producing rotating motion to reciprocating motion for the second reciprocating member substantially free of any side forces.

6. A cryogenic refrigerator according to claim 5 wherein the first drive mechanism's forward driving means operatively connected to the connecting rod is a cam and the force receiving means includes a bearing plate upon which the cam acts to drive the first reciprocating member forward.

7. A cryogenic refrigerator according to claim 6 wherein the return means includes a compression spring in operative association with the bearing plate for compression during the forward motion of the cam and expansion during the backward motion of the cam to drive the reciprocating member backward substantially simultaneously with the cam movement.

8. A cryogenic refrigerator according to claim 7 wherein the bearing plate is a flanged rod, and further comprising a sleeve member said sleeve member coacting with the flanged rod to form a clearance seal and a clearance seal housing for rigidly supporting the sleeve member, said sleeve member and flanged rod coacting to form stops for the compressed spring.

9. A cryogenic refrigerator according to claim 8 wherein the first reciprocating member is a regenerator/displacer rigidly fixed to the end of the flanged rod opposite the flanged end of the flanged rod.

10. A cryogenic refrigerator according to claim 9 wherein the guide means having a moveable means operably connected to the second end of the connecting rod reciprocating the second reciprocating member further includes a guide member and said moveable means is a hollow body having an end portion slidably mounted in said guide member and journaled to the second end of the connecting rod, a body portion extending beyond the first end of the connecting rod and an end portion having the second reciprocating member rigidly affixed thereto.

11. A cryogenic refrigerator according to claim 10 wherein the second reciprocating member rigidly affixed to the hollow body is a cryogen compressor piston.

12. A cryogenic refrigerator according to claim 11 further includes a sleeve member in operative association with the cryogen compressor piston to form a clearance seal.

13. A reciprocating device comprising: a reciprocating member, means for producing rotary motion, and a drive mechanism including a reciprocating piston guide assembly means operably connected to the reciprocating member and to the means for producing rotary motion for converting the rotary motion to reciprocating motion for reciprocating the reciprocating member substantially free of any side force vector, wherein said drive mechanism includes a connecting rod having first and second ends and said piston guide assembly means includes a guide member and a hollow member having an end portion, a body portion and an end opposite the end portion, the first and second ends of the connecting rod being connected, respectively, to the means for producing rotary motion and to the end portion of the hollow body, the end portion of the hollow body being slidably mounted in the guide member, the body portion of the hollow body circumscribing the connecting rod and extending from the end portion beyond the first end of the connecting rod to the end opposite the end portion, and the end opposite the end portion being rigidly affixed to the reciprocating member whereby the reciprocating member can be of any preselected size and is reciprocated by the hollow member substantially free of side forces in response to the drive mechanism and means for producing rotary motion.

* * * * *